US005081505A

United States Patent [19]

Ziegelmuller et al.

[11] Patent Number: 5,081,505

[45] Date of Patent: Jan. 14, 1992

[54] CLEANING APPARATUS HAVING INDEXABLE WIPER BLADES

[75] Inventors: Francisco L. Ziegelmuller, Penfield; Conrad Altmann, Rochester, both of N.Y.

[73] Assignee: Eastman Kodak Company, Rochester, N.Y.

[21] Appl. No.: 561,383

[22] Filed: Aug. 1, 1990

[51] Int. Cl.[5] ..... G03G 21/00

[52] U.S. Cl. ..... 355/299; 15/256.5; 15/256.51; 355/297

[58] Field of Search ..... 355/296–299; 15/256.5, 256.51, 256.52

[56] References Cited

U.S. PATENT DOCUMENTS

| | | | |
|---|---|---|---|
| 3,660,863 | 5/1972 | Gerbasi | 15/256.51 |
| 3,706,108 | 12/1972 | Taylor | 15/1.51 |
| 3,848,993 | 11/1974 | Hasiotis | 355/299 |
| 3,851,965 | 12/1974 | Furuichi et al. | 355/270 X |
| 3,977,898 | 8/1976 | Hwa | 15/256.51 X |
| 4,174,172 | 11/1979 | Lane | 15/256.5 |
| 4,202,437 | 5/1980 | Gordon | 15/256.5 X |
| 4,295,239 | 10/1981 | Myochin | 15/1.51 |
| 4,469,434 | 9/1984 | Yamazaki et al. | 355/299 |
| 4,568,175 | 2/1986 | Inowa et al. | 355/299 |
| 4,577,955 | 3/1986 | Mayer | 15/256.51 X |
| 4,937,633 | 6/1990 | Ewing | 355/299 |

FOREIGN PATENT DOCUMENTS

| | | | |
|---|---|---|---|
| 0223773 | 10/1986 | Japan | 355/299 |
| 0035389 | 2/1987 | Japan | 355/299 |

*Primary Examiner*—A. T. Grimley
*Assistant Examiner*—J. E. Barlow, Jr.
*Attorney, Agent, or Firm*—Tallam I. Nguti

[57] ABSTRACT

A rotatable wiper blade roller for cleaning residual toner particles from an image-bearing surface includes a shroud, a plurality of indexable wiper blades that each engage the image-bearing surface at an angle of 60° to 85° defined in the direction of particle removal by the cleaning edge of each such blade and the image-bearing surface, that are each cleaned secondarily by an intermittently rotatable fur brush that is completely out of contact with the image-bearing surface.

10 Claims, 2 Drawing Sheets

CLEANING APPARATUS HAVING INDEXABLE WIPER BLADES

BACKGROUND OF THE INVENTION

This invention relates to electrostatographic cleaning apparatus, and more particularly, to an effective, long-life blade-cleaning apparatus having means for removing trapped particles therefrom.

Electrostatographic process equipment, which produce or reproduce toned images on selected substrates by employing electrostatic charges and toner particles on an image-bearing surface such as an insulated photoconductive surface, typically operate through a sequence of currently well known steps. These steps include (1) charging of the insulated photoconductive surface with electrostatic charges, (2) forming an electrostatic image on such surface by selectively discharging areas on such surface that are the equivalent of the background of the image being formed, (3) developing the electrostatic image so formed with particles of toner, (4) transferring the toned image to a suitable substrate for fusing, and (5) cleaning the image-bearing surface by removing residual particles and fibers therefrom in preparation for similarly reusing the surface for producing another image.

The quality of the images produced by such equipment depends significantly on the ability to clean the photoconductive surface before it is reused.

Several types of cleaning apparatus, including blade-type cleaners as disclosed, for example, in commonly assigned U.S. Pat. No. 3,706,108, issued Dec. 19, 1972 in the name of Taylor, have therefore been developed for cleaning the photoconductive and other image-bearing surfaces in such equipment. The life and long-term effectiveness of such blade-cleaning apparatus, however, depend significantly on how close to the surface, and how free of trapped particles and fibers, the cleaning edge of each blade is.

This is because particles and fibers, trapped on or between the cleaning edge of a blade and the surface being cleaned, tend to space the cleaning edge from such surface, thereby resulting in poor and ineffective cleaning. Furthermore, such trapped particles and fibers also undesirably cause non-uniform wearing and scratching of such surface, for example, an image-bearing surface, which then results in poor image quality.

Conventional mechanisms and attempts to minimize the detrimental effects of particles and fibers being trapped between the cleaning blade and the surface being cleaned are disclosed, for example, in the '108 patent and in U.S. Pat. No. 4,295,239. Such attempts have included, for examples, use of plurality of continuously rotating cleaning blades, and of a passive flicker bar which, in turn, cleans each rotating blade during such rotation. It has been observed, however, that such conventional mechanisms are only minimally effective, and that they frequently have to be replaced due to cleaning failure or due to damage to the surface, especially an image-bearing surface.

Additionally, it has been found that the trapping of residual particles and fibers between the cleaning edge of a cleaning blade and the surface being cleaned is, in significant part, a function of several factors. These factors, for example, include: (a) the cleaning angle the blade edge makes with such surface, (b) the effectiveness of the seal at such an angle between the cleaning edge and the surface, (c) the normal force applied by the cleaning edge to the surface being cleaned, and (d) how long fibers remain trapped, as well as how well such trapped fibers are removed from a cleaning edge before such edge recontacts the surface being cleaned. Conventional cleaning apparatus as disclosed in the '108 and '239 patents are therefore limited for examples because a continuously rotating cleaning blade makes only a momentary contact and seal with the surface being cleaned, and because some particles and fibers that are trapped on the blade during cleaning, due to a lack of mass for instance, cannot be removed from the trapping edge by a mera passive blade flicker.

SUMMARY OF THE INVENTION

It is an object of the present invention to provide a blade-cleaning apparatus for effectively removing residual particles and fibers from an image-bearing surface of an electrostatographic copier or printer.

It is further object of the present invention to provide such a cleaning apparatus having a relatively longer-term effectiveness, and a longer life than similar conventional apparatus.

In accordance with the present invention, a cleaning apparatus comprises a plurality of cleaning blades, including at least a first blade and a second blade, mounted on a movable member, and a housing substantially surrounding the cleaning blades. Each blade has a cleaning edge for engaging or contacting and sealing against, and for removing residual particles and fibers from, an image-bearing surface of an electrostatographic copier or printer. Additionally, each blade has a first position for such cleaning engagement with the image-bearing surface, a predetermined cleaning angle, and a second position away from such surface. The cleaning apparatus further comprises a secondary and prolonged-cleaning means at the second position for actively and effectively removing trapped particles and fibers from the cleaning edge of each cleaning blade in such second position. The cleaning apparatus also comprises means for periodically indexing the plurality of cleaning blades so as to move the cleaning edge of the first blade from the first position into the second position where it will be cleaned by the prolonged, secondary cleaning means. The indexing means also moves a new blade, which has a cleaned cleaning edge, into the first position for continued effective cleaning of the image-bearing surface.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
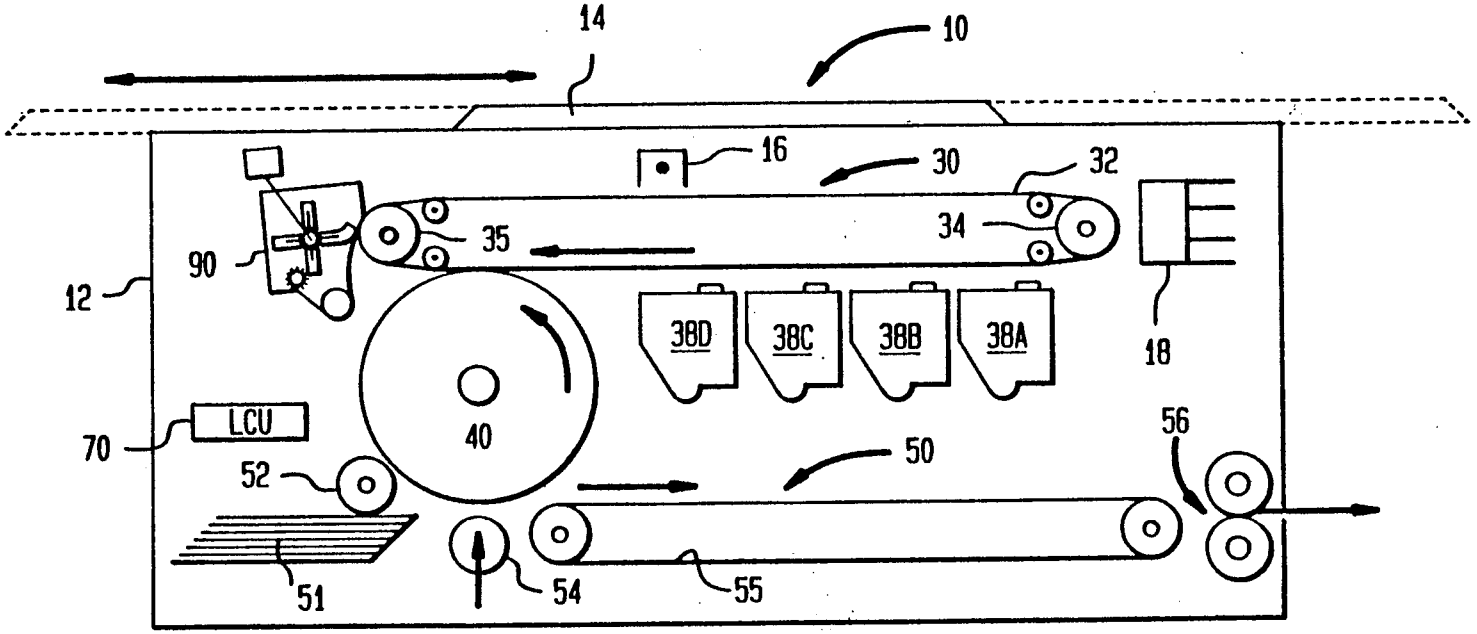
FIG. 1 is a schematic of an electrostatographic copier or printer embodying the cleaning apparatus of the present invention.

Referring now to FIG. 1 of the drawings, an electrostatographic copier or printer designated generally as 10, includes for example a housing 12, a document handling platen 14, a primary charger 16 and an electronic printhead 18. The copier or printer 10, for example, also includes an image-bearing member such as a photoconductor 30 having an image-bearing surface 32, four development stations 38A, 38B, 38C and 38D, and image transfer-related member 40 having a surface 42, a copy sheet han174 control unit 70. The image-bearing surface 32 is cleaned, for example, by the cleaning apparatus of the present invention which is denoted generally as 90.

The photoconductor 30 is shown as a wide flexible endless web trained about rollers 34, 35. It is divided into four image frames, for example, and thus is capable of holding up to four different images at a time on its surface 32. On the other hand, the image transfer-related member 40, as illustrated, is only as large as one image frame. The member 40, as shown, is a rigid drum contacting and extending across the entire width of the photoconductor 30. Both the photoconductor 30 and the member 40 are electrically biased, creating an electrical field that enhances toner particle transfer from the surface 32 of the photoconductor 30 onto the member 40. Images transferred thus to the member 40 are then transferred to a copy sheet 51.

The copy sheet 51 is fed from a stack of such sheets by a roller 52 and is urged into registered contact with the member 40, for example, by the roller 54. After receiving the image from the member 40, the copy sheet 51 is thereafter moved by a sheet transfer system 55 to a fusing station 56 where the image is fused to form the copy. It should be noted that the photoconductor 30 can also be a rigid drum, and that when the member 40 is an image-bearing intermediate member, it can also be in the form of a flexible web that is trained about a set of rollers.

After image transfer from a portion of the photoconductor 30 to the member 40, that particular portion of the photoconductor 30 continues to move on downsteam where it is cleaned by the cleaning apparatus 90 of the present invention. As shown, the apparatus 90 is located downstream of the nip formed by the photoconductor 30 and the member 40.

Figure 2:
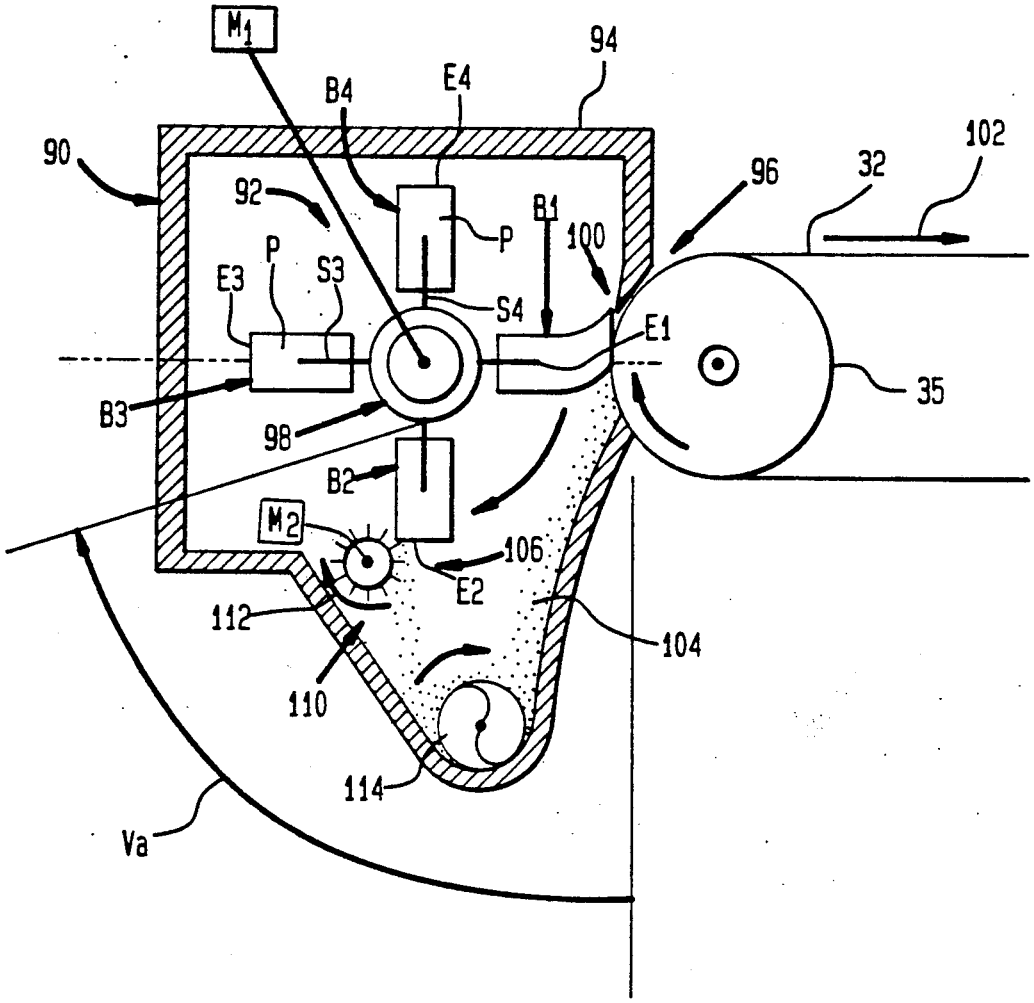
FIG. 2 is an enlarged cross-sectional view of the cleaning apparatus of the present invention.
Figure 3:
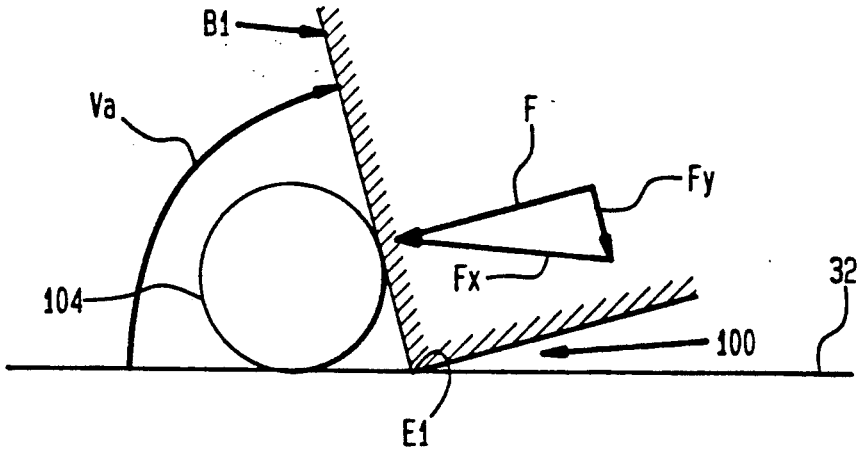
FIG. 3 is a detailed illustration of the cleaning angle and cleaning force parameters of the present invention.

Referring now to FIGS. 2 and 3, the cleaning apparatus 90 of the present invention comprises a plurality of cleaning blades designated generally as 92. The plurality of blades 92 includes at least a first blade B1 and a second blade B2. Additional blades such as blades B3 and B4 may also be added. Although only four blades are shown, any number of blades including the first and second blades B1, B2, may be used in the structure of the present invention.

The cleaning apparatus 90 also includes a housing 94 which substantially surrounds the cleaning blades 92. The housing 94 has a cleaning aperture 96 with edges which are adapted to fit in a sealing manner against the surface, such as the image-bearing surface 32 being cleaned.

Within the housing 94, the blades B1 to B4 are mounted on a movable holding member 98. As shown, each blade is made of polymeric material P for example, see blades B3 and B4. As such, each blade B1 to B4 is flexible and compliant or springy, and so is suitably used as a wiper blade. As shown clearly in FIG. 2, when a wiper blade such as B1 is in cleaning engagement with a surface being cleaned, the cleaning tip of such blade will be deflected substantially backwards relative to the direction of movement of such blade. The holding member 98 may consist of a roller portion which is keyed to a shaft for movement therewith. The holding member 98 also consists of a series of spaced-apart spoke-like members S1 to S4, (only S3 and S4 of which are shown in FIG. 2) onto which the blades B1 to B4 are removably mounted. The roller and spokes S1-S4 of holder member 98 may be metallic. Although such spokes S1 to S4 are shown spaced 90° apart, such spacing, however, is only as an example. As shown in FIG. 2, the holding member 90 is movable so as to move the blades B1 to B4 in a clockwise direction, for example. The member 98 may be so moved by a drive means such as an electric motor M1.

Each blade B1 to B4 includes a sharpened cleaning edge shown as E1, E2, E3 and E4, respectively, which can be rotated into forming a sealing and cleaning contact or engagement with the surface 32 being cleaned. However, as clearly shown in FIG. 2, each blade B1 to B4 has a rectangular cleaning tip that includes two such sharp edges of which the cleaning edge E1, E2, E3 or E4 is the lead edge thereof relative to the direction of rotation of the blades.

In the present invention, the movable plurality of blades 92 has a first stationary position 100 into which each of the blades B1 to B4 can be moved for wipingly engaging, sealing against, and cleaning the image-bearing surface 32. For example, in FIGS. 2 and 3, the first blade B1 is shown in this first position 100. The apparatus 90 is mounted such that the cleaning edge of a blade in this first position, for example the edge E1 of the first blade B1, will make a wiping and cleaning contact with the surface 32 at a desirable and predetermined cleaning angle shown as Va. The cleaning angle Va as shown in the acute angle defined by the surface 32 and a cleaning edge E1, E2, E3 or E4 of the deflected cleaning tip of the wiper blade being used, in the direction in which the removed particles 104 are being swept. With the surface 32 being moved, for example in the direction of the arrow 102, the cleaning edge of the blade in the first position, for example the edge E1, will wipe and remove residual toner and other particles 104 (FIG. 3) from such surface. In the present invention, each blade B1 to B4 is movable into and out of the first position 100, but each such blade is held in a stationary condition while performing such cleaning in such first position.

Accordingly, the cleaning apparatus 90 further consists of means including the electric motor M1 and the programmable logic and control uunit 70 for periodically indexing and thus moving the plurality of blades 92. Each such indexing movement is such as to move the cleaning edge of a blade, for example the edge E1 of the first blade B1, from the stationary first position 100 where it is in cleaning contact with the surface 32, into a stationary second position shown as 106 which is remote from the surface 32. Indexably moving a blade, for example the first blade B1, from the first to the second position, simultaneously will also move a new blade, for example B4, into the first and cleaning contact or engagement position 100 with the surface 32. Thus, in the present invention, such indexing can continue around and around with each blade B1 to B4 being cyclically and periodically moved, respectively, into and out of the first and second stationary positions 100 and 106.

During such cyclical movement, as each blade B1 to B4 is indexed into the stationary first position 100, the respective cleaning edge E1, E2, E3 or E4 thereof will first lightly contact, and then gradually press against the surface 32 due to a compressive force shown as Fy being applied to the blade in such position. Such behavior of the blade edge is also due to the springy nature of the polymeric material P of each blade. Such gradual pressing of the cleaning edge, for example, E1, causes the edge to deform and thereby to conform more precisely to the surface 32. Because the blade, for example B1, in the first position 100 is held stationary in such position for as long a period as is desired, there is advantageously a longer period of time and greater opportunity for the cleaning edge, for example E1, to conform more precisely to the surface 32, than would be the case with a continuously rotating cleaning blade. Such precise conformity of the cleaning edge with the surface being cleaned results in an effective seal of the cleaning edge against the surface 32. A more precise seal, as such, will prevent substantial or significant quantities of fibers and particles 104 from being trapped between such cleaning edge and the surface 32.

As shown in FIG. 3, the cleaning blade such as B1 in such sealing contact in the first position 100 with the surface 32, will contact residual particles 104 at the cleaning angle Va, and will apply a normal force F onto each such particle. As shown, such force F is a function of the angle Va, and can be decomposed into the compressive force Fy, and into a particle removal and shearing force Fx. The compressive force Fy has the undesirable tendency of digging into, and scratching the surface 32, while the shearing Fx is desirable for particle removal.

It has been found that for a given force F, the smaller the cleaning angle Va is, the larger Fy will be while the smaller Fx will be. Small cleaning angles Va are, accordingly, undesirable since they result in a less particle removing force Fx, and instead in a greater and undesirable surface damaging force Fy. A large cleaning angle Va of about 78° has been found to be most effective, with acceptable results being achievable with angles within a range of 60°-85°. A cleaning angle within this range effectively reduces the compressive force Fy while increasing the particle removal force Fx for the same force F being applied by a blade such as B1 onto a particle 104.

Even at such a cleaning angle Va, the effectiveness of the cleaning edge still depends on the actual magnitude of the particle-removal force Fx. This magnitude, of course, is a direct function of the normal force F being applied by the blade against the particles 104. Good cleaning results have been obtainable, for example, when a normal force F in the range of 0.05 lb/in to 0.25 lb/in has been applied. The preferred range of F for cleaning surfaces 32 in conventional commercial electrostatographic copiers and printers has been fouund, for example, to be 0.10 lb/in to 0.18 lb/in.

Accordingly, in the present invention, indexing one of the cleaning blades B1 to B4 into the stationary position 100, at a cleaning angle Va between 60°-85° and with a normal force between 0.10 lb/in to 0.18 lb/in, will desirably result in an effective seal of the cleaning edge thereof against the surface 32, and in good cleaning. The trapping of residual fibers and particles between such cleaning edge, for example E1, and the surface 32 should be substantially reduced.

However, some fibers and particles, particularly very small and very fine fibers which have little to no mass, still are trapped by the cleaning edge such as the E1 against the surface 32. If allowed to remain so trapped, even these small and fine particles and fibers will eventually begin to undesirably scratch the surface 32, as well as undesirably push the cleaning edge out of a desired sealing contact with the surface 32, thereby resulting in poor cleaning.

To prevent such undesirable results, the present invention periodically indexes such cleaning edge from the cleaning first position 100, into the remote, second stationary position 106. Additionally, the cleaning apparatus 90 of the present invention includes a secondary cleaning means 110 at such second position 106 for actively and effectively removing the trapped fibers and particles from the cleaning edge of the stationary blade in such second position.

For example, the second cleaning blade B2 is shown (FIG. 2) in the second position 106. The secondary cleaning means can be a foam roller or preferably a fiber brush 112 which is mounted so as to make interference contact with the cleaning edge, such as the edge E2, of each cleaning blade B1 to B4 that has been indexed from the first position 100 into the second position 106. The brush 112 is rotatably movable by means such as an electric motor M2, relative to such cleaning edge, for example the edge E2, of the stationary cleaning blade in the second position 106. Because the blade B1 to B4 will be held stationary for a significantly long time in such second position 106, the brush 112 can be activated and run for as prolonged a period of time as is desired in order to actively and effectively remove trapped fine fibers and small particles which would otherwise be difficult to remove by more mechanical flicking. As a consequence, each cleaning edge E1 to E4 is effectively cleaned at the second position 106 as the plurality of blades 92 are periodically indexed.

Such periodic indexing and prolonged secondary cleaning of each cleaning edge, of course, insures effective cleaning of the surface 32, as well as a relatively much longer life for the cleaning apparatus 90. Worn out blades can be replaced individually on each spoke S1 to S4.

As is well known, the cleaning apparatus 90, as shown, may also include a cleaned-off particle transport means such as an auger 114 which is mounted within a trough or sump portion of the housing 94 directly below the first and second positions 100 and 106 of the blades B1 to B4.

The invention has been described in detail with particular reference to a presently preferred embodiment, but it will be understood that variations and modifications can be effected within the spirit and scope of the invention.

What is claimed is:

1. An effective, long life cleaning apparatus for removing residual particles and fibers from an image-bearing surface in an electrostatographic copier or printer, the cleaning apparatus comprising:

(a) a plurality of wiper cleaning blades, including at least a first blade and a second blade, mounted on a rotatably movable member, each said blade having a cleaning tip including a cleaning edge for removing residual particles and fibers from an image-bearing surface of an electrostatographic copier or printer, and each said blade having a stationary first position for engaging and cleaning the image-bearing surface, a predetermined cleaning angle within the range of 60°-85° defined by said cleaning edge of the cleaning tip deflected backwards, and the image-bearing member in the direction of particle removal, and a stationary second position spaced from such image-bearing surface;

(b) a housing substantially surrounding said cleaning blades;

(c) prolonged secondary cleaning means at said stationary second position for actively and effectively removing trapped fibers and other particles from the cleaning edge of each said cleaning blade in said second position said secondary cleaning means being spaced from and out of contact with the image-bearing member; and (d) means for periodically indexing said plurality of cleaning blades so as to move the cleaning edge of a cleaning blade from said first position into said second position to be cleaned thereat by said secondary cleaning means, and so as to rotatably move a new cleaning blade, having a cleaned cleaning edge, into said first position for continued effective cleaning of the image-bearing surface.

2. The cleaning apparatus of claim 1 wherein said driven member is a rotatable shaft.

3. The cleaning apparatus of claim 1 wherein said predetermined cleaning angle is 78°.

4. The cleaning apparatus of claim 1 wherein said plurality of blades are mounted within said housing so as to produce a desired normal force of 0.10 lb/in to 0.18 lb/in by each said blade in said first position against the particles being removed.

5. The cleaning apparatus of claim 1 wherein said secondary cleaning means comprises a driven fiber brush and drive means for rotatably driving said fiber brush relative to the cleaning edge of a stationary cleaning blade in said second position.

6. An effective, long life cleaning apparatus for removing residual particles and fibers from an image-bearing surface in an electrostatographic copier or printer, the cleaning apparatus comprising:

(a) a plurality of wiper cleaning blades, including at least a first blade and a second blade, mounted on a rotatably movable member, each said blade having a cleaning tip including a cleaning edge for removing residual particles and fibers from an image-bearing surface of an electrostatographic copier or printer, and each said blade having a stationary first position for engaging and cleaning the image-bearing surface, a predetermined cleaning angle within the range of 60°–85° defined by said cleaning edge of the cleaning tip deflected backwards, and the image-bearing member in the direction of particle removal, and a stationary second position spaced from such image-bearing surface;

(b) a housing substantially surrounding said cleaning blades;

(c) secondary cleaning means at said stationary second position for actively and effectively removing trapped fibers and other particles from the cleaning edge of each said cleaning blade in said second position said secondary cleaning means being spaced from and out of contact with the image-bearing member; and (d) means for periodically indexing said plurality of cleaning blades so as to move the cleaning edge of a cleaning blade from said first position into said second position to be cleaned thereat by said secondary cleaning means, and so as to rotatably move a new cleaning blade, having a cleaned cleaning edge, into said first position for continued effective cleaning of the image-bearing surface.

7. The cleaning apparatus claim 6 wherein said rotatably movable member for mounting said blades includes a plurality of spoke-like metallic members for holding the blades.

8. The cleaning apparatus of claim 6 including an auger located below said first and second positions for transporting removed particles away from the image-bearing surface.

9. The cleaning apparatus of claim 6 wherein each said wiper blade is substantially deflected when the cleaning edge thereof is in said first position in cleaning engagement with the image-bearing member.

10. The cleaning apparatus of claim 7 wherein each blade is removably mounted onto each said spoke-like member.

* * * * *